United States Patent [19]

Hamashima et al.

[11] Patent Number: 4,607,683

[45] Date of Patent: Aug. 26, 1986

[54] METHOD OF MANUFACTURING THIN METAL WIRE

[75] Inventors: Tatsuo Hamashima, Osaka; Hisayasu Tsubata; Michiaki Hagiwara, both of Kyoto, all of Japan

[73] Assignee: Unitika Ltd., Hyogo, Japan

[21] Appl. No.: 471,600

[22] Filed: Mar. 3, 1983

[30] Foreign Application Priority Data

Mar. 3, 1982 [JP] Japan ..... 57-34490

[51] Int. Cl.[4] ..... B22D 11/06

[52] U.S. Cl. ..... 164/463; 164/423; 164/429; 164/466; 164/498; 164/500; 164/502

[58] Field of Search ..... 164/462, 463, 479, 423, 164/427, 429, 466, 498, 500, 147.1, 502

[56] References Cited

U.S. PATENT DOCUMENTS

| | | | |
|---|---|---|---|
| 3,315,958 | 4/1967 | Geeson | 271/68 |
| 3,627,025 | 12/1971 | Tromel | 164/463 |
| 3,845,805 | 11/1974 | Kavesh | 164/423 |
| 4,221,257 | 9/1980 | Narasimhan | 164/429 |
| 4,506,725 | 3/1985 | Bedell | 164/463 |
| 4,523,626 | 6/1985 | Masumoto | 164/463 |
| 4,527,614 | 7/1985 | Masumoto | 164/463 |

FOREIGN PATENT DOCUMENTS

| | | | |
|---|---|---|---|
| 5564948 | 10/1978 | Japan | 164/463 |

OTHER PUBLICATIONS

Oonaka (Ohnaka), Production of Pd-Cu-Si Amorphous Wires by Melt Spinning Method Using Rotating Water, Scripta Metallurgica, vol. 15, #3, pp. 293-296, Mar. 1981.

*Primary Examiner*—Nicholas P. Godici
*Assistant Examiner*—C. McKee
*Attorney, Agent, or Firm*—Sughrue, Mion, Zinn Macpeak & Seas

[57] ABSTRACT

A thin metal wire having a circular cross section is produced by a method which comprises spouting molten metal through a spinning nozzle and bringing the resultant flow of molten metal into contact with a layer of liquid cooling medium formed on a grooved conveyor belt in motion thereby quenching and solidifying the flow of molten metal. This method is capable of continuously producing a thin metal wire of high quality economically on a commercial scale. It is highly effective in directly producing a thin metal wire having an amorphous, non-equilibrium crystalline, or microcrystalline structure.

20 Claims, 6 Drawing Figures

METHOD OF MANUFACTURING THIN METAL WIRE

FIELD OF THE INVENTION

This invention relates to a method for producing a thin metal wire of a circular cross section directly from molten metal, and more particularly, to a novel method for the manufacture of a thin metal wire. The method is characterized by bringing a flow of molten metal spouted from a spinning nozzle directly into contact with a running body of liquid coolant thereby suddenly cooling and solidifying the molten metal.

BACKGROUND OF THE INVENTION

Producing thin metal wire directly from molten metal is an inexpensive method of production. Moreover, the thin metal wire produced by this method is characterized by retaining the physical properties peculiar to the metal and, therefore, being suitable for use in electric and electronic parts, composite materials, and textile materials. Further, the metal wire can exhibit high tensile strength because of its small thickness. Therefore, the wire is a promising material in various industrial applications. If the thin metal wire obtained by being super-quenched possesses a circular cross section and an amorphous, non-equilibrium crystalline, or microcrystalline structure, it has a strong possibility of exhibiting numerous outstanding chemical, electromagnetic, and physical characteristics and finding practical utility in a host of fields. A number of methods have heretofore been developed for producing a thin metal wire of uniform quality at a low cost. One of these methods contemplates producing the thin metal wire in the same manner as the melt spinning of synthetic fibers currently adopted for mass production. The melt-spinning method for producing a thin wire of metal by drawing a metal in a molten state was developed by Pond et al. around 1958. This method has been studied in two versions; the staple method which comprises spouting molten metal through a spinning nozzle onto a rotary plate in motion and drawing the flow of molten metal with centrifugal force, and the continuous method which comprises spouting molten metal through a spinning nozzle into an atmosphere of inert gas and cooling the flow of molten metal into a continuous thin wire. The staple method produces a flat metal ribbon, which finds utility only in special applications as described in U.S. Pat. No. 2,825,108. The continuous method is utilized chiefly for metals of low melting points, because it requires a liquid metal of low viscosity to be cooled and solidified while the liquid metal is flowing with its continuity retained intact as described in U.S. Pat. Nos. 2,907,082 and 2,976,590.

In the meantime, a method of composite spinning which utilizes the spinnability of glass in producing a thin continuous wire by melt spinning a metal of high melting point is now under development. The methods described above, however, invariably entail too numerous problems to permit commercial production of a thin metal wire of high quality having a circular cross section at a low cost. A present conventional method for melt spinning of a metal wire will be described more specifically below.

Unlike a highly viscous molten substance such as of high molecular polymer, molten metal has extremely low viscosity and high surface tension. To produce a thin continuous wire from the molten metal by an ordinary melt spinning method, therefore, due consideration should be paid to the spouting speed and the solidifying speed of the flow of molten metal in connection with the two major factors, i.e., gravitational breakage and vibrational fracture in the spouted flow of molten metal. These problems are theoretically discussed in detail in *Journal of Textile Society,* Vol. 28, No. 1, page 23 (1972), for example. The most important question in this case, therefore, is how to lower the solidification limit which is liable to be inversely proportional to the difference between the temperature of the molten metal and that of the ambient air relative to the gravitational breakage limit which is liable to be proportional to the reciprocals of surface tension and specific gravity, namely, how to effect rapid cooling and solidification of the molten metal. Methods which are directed to stabilizing an extremely unsteady flow of molten metal spouted out of the spinning nozzle have also been proposed to the art. Japanese Patent Publication No. 24013/70, for example, discloses a method which, as a measure for stabilizing the flow of molten metal for the sake of cooling and solidifying activities, comprises spinning the molten metal into an atmosphere of a gas reactive with the metal thereby causing formation of a film of oxide or nitride on the surface of the thin flow of molten metal. A careful study of this method, however, reveals that it is extremely difficult for the molten metal to be stabilized so perfectly as though in a solidified state solely by the formation of such a film. Even when the film is formed, the molten metal is discontinuously deformed by virtue of gravitational attraction. Thus, the formation of the film hardly keeps pace with the constant renewal of the surface of the molten metal. In an extreme case, the flow of molten metal may have portions covered with a perfectly formed film and portions either covered with an insufficiently formed film or not covered at all, imparting detestable uniformity to the produced thin metal wire or causing fracture and breakage in the flow of molten metal. Worse still, this method only permits use of specific metals which are capable of forming a film of oxide or nitride.

Japanese Patent Application (OPI) Nos. 56560/73 and 71359/73 (the term "OPI" as used herein refers to a "published unexamined Japanese patent application") also suggest methods which spout the molten metal into a dense aggregate of froths or into a mass of bubbles and effect cooling and solidification of the flow of molten metal. These methods fall short of amply stabilizing the flow of molten metal because their cooling and solidifying speeds are quite slow. Recently, the so-called liquid quenching method which produces a uniform, continuous thin metal wire by causing the flow of molten metal spouted out of the spinning nozzle to come into contact with the surface of a solid roll rotating at a high speed before the molten metal sustains gravitational breakage or vibrational fracture thereby quenching and solidifying the molten metal at a high speed has been studied and proposed in various versions. Since this method provides the cooling at an extremely high speed of about $10^{5}$° C./seconds, it proves to be a highly advantageous method for stably producing a metal ribbon of high quality having an amorphous, nonequilibrium crystalline, or microcrystalline structure. Unfortunately, this method only produces a metal wire of flat faces, which finds utility only in special applications. This method, therefore, is incapable of producing a thin metal wire having a circular cross section.

Japanese Patent Application (OPI) No. 135820/79 (corresponding to U.S. Pat. No. 3,845,805) discloses a method which, for the purpose of producing a thin metal wire having a circular cross section, causes the flow of molten mettal to be passed through a quenching zone formed of a liquid medium and, consequently, effects solidification of the molten metal. The essential requirements for this invention are (1) that, in the quenching zone, the flow of molten metal just spouted out of the spinning nozzle and that of the liquid cooling medium are parallel to each other and (2) that the relative speed between the flow of molten metal spouted out of the spinning nozzle and that of the liquid cooling medium relies on the speed of the gravitational fall of the liquid cooling medium. Thus, the speed is 180 m/min. at best and cannot be increased any more. By this method, therefore, the speed of quenching and solidification cannot be easily increased.

The largest disadvantage of this method resides in the fact that since the flow of the liquid cooling medium is caused by its own gravitational fall, the disturbance consequently produced in the flow of the liquid cooling medium cannot be easily controlled. This disturbance in the flow of the liquid cooling medium is aggravated when the speed of the liquid cooling medium is increased. When the flow of molten metal is brought into contact with the liquid cooling medium in such heavy disturbance to be quenched and solidified, there are barely produced short lengths of thin metal wire heavily lacking uniformity of diameter and abounding in deformation. Thus, this method has no practicability. To obtain a thin metal wire of high quality and high performance having an amorphous, non-equilibrium crystalline, or microcrystalline structure, the flow of molten metal must be quenched and solidified at a cooling speed of not les than $10^4$° C./second. In this method, the cooling speed is not sufficient because the molten metal and the liquid cooling medium are flowing parallelly to each other at an equal, low speed within the quenching zone. Thus, this method cannot produce a thin metal wire of high quality having a circular cross section and an amorphous, non-equilibrium crystalline, or microcrystalline structure. Further, since the liquid cooling medium flows at a slow speed, it possesses a small kinetic energy. The liquid cooling medium itself and the surface thereof, therefore, are disturbed by the collision of this medium with the flow of molten metal spouted through the spinning nozzle and by the boiling, vaporization, and convection of the liquid medium, making it impossible to produce a thin metal wire of high quality having a circular cross section.

Japanese Patent Application (OPI) No. 69430/76 discloses a method which, in bringing the flow of molten metal into contact with the liquid cooling medium thereby effecting cooling and solidification of the molten metal for the purpose of producing a continuous thin metal wire having a uniform, circular cross section, limits the angle of contact between the liquid cooling medium and the flow of molten metal spouted out of the spinning nozzle to below 20° and fixes the flow speed, V (m/min), of the liquid cooling medium within the range of $V_M < V \leqq 5/2V_M$ (wherein $V_M$ denotes the speed (m/min) of the flow of molten metal spouted out of the spinning nozzle). This method is advantageous for the purpose of minimizing the collision between the flow of molten metal and that of the liquid cooling medium and producing a continuous thin metal wire having a uniform, circular cross section. This method, however, falls short of providing perfect control of the disturbance in the flow of the liquid cooling medium. Since the angle of contact between the flow of molten metal and that of the liquid cooling medium is small, the cooling speed obtained at all by this method is not sufficient for a metal which is capable of forming an amorphous, non-equilibrium crystalline, or microcrystalline structure when cooled at a sufficiently high speed. By this method, therefore, it is difficult to produce a thin metal wire having an amorphous, non-equilibrium crystalline, or microcrystalline structure and, therefore, excelling in chemical, electromagnetic, and physical properties. Similarly to the method taught by the aforementioned Japanese Patent Application (OPI) No. 135820/74 (corresponding to U.S. Pat. No. 3,845,805), this method has a disadvantage that the liquid cooling medium is disturbed when the flow speed thereof is increased.

Japanese Patent Application (OPI) No. 64948/80 teaches a so-called rotary liquid spinning method which cools and solidifies the flow of molten metal spouted out of the spinning nozzle by introducing this flow of molten metal into a rotary member containing a liquid cooling medium. In this method, the flow of the liquid cooling medium is stabilized by virtue of centrifugal force even when the flow speed of the medium is increased and the cooling medium provides cooling of the molten metal at a high speed. This method, therefore, proves to be advantageous for the purpose of producing a thin metal wire of high quality having a circular cross section in a small lot. This method, however, maintains the layer of liquid cooling medium within the rotary member cylinder and collects the cooled and solidified thin metal wire continuously as wound up on the inner wall of the rotary cylinder. Consequently, the depth of the layer of liquid cooling medium, the windup speed, the temperature of the liquid cooling medium, etc., are varied. The present method, accordingly, entails too many problems to permit effective continuous, mass production of a thin metal wire of uniform quality. Further, this method must be worked out in a batchwise operation by all means because the rotary cylinder has rigidly limited inner volume and width. It is extremely difficult for this method to be carried out in a continuous operation on a commercial scale. This method by nature necessitates installation of one rotary cylinder for each spinning nozzle in use and, therefore, tends to call for huge cost for equipment and power supply.

SUMMARY OF THE INVENTION

An object of this invention is to provide a method which can be applied to pure metals, metals containing minute amounts of impurities, and all alloys formed of two or more elements and which permits direct production of a thin metal wire of very high quality having a circular cross section from a molten mass of such metal.

Another object of this invention is to provide a method which permits economic production of a thin metal wre of high quality from the aforementioned molten metal without having to rely for stabilization of the spouted flow of molten metal upon any special measure.

Still another object of this invention is to provide a method which permits economic production of a thin metal wire directly from a metastable alloy such as, for example, an amorphous alloy, a non-equilibrium crystalline alloy, or a microcrystalline alloy or from an inductile alloy which cannot be easily converted into a thin metal wire by an ordinary measure.

A further object of this invention is to provide a method which permits the production of a thin metal wire to be economically carried out in a continuous operation on a commercial scale.

The present inventors continued an extensive investigation for the purpose of accomplishing the objects described above. They have consequently found that all the objects enumerated above are fulfilled by causing the spouted flow of molten metal to be brought into contact with a layer of liquid cooling medium formed on a grooved conveyor belt travelling in a highly stabilized condition thereby quenching and solidifying the molten metal. This invention has been perfected on the basis of this knowledge.

Specifically, the present invention relates to a method for the manufacture of a thin metal wire having a circular cross section, characterized by the steps of spouting molten metal through a spinning nozzle and bringing the spouted flow of molten metal into contact with a layer of liquid cooling medium formed on a grooved conveyor belt in motion thereby quenching and solidifying the molten metal.

The thin metal wire having an amorphous, non-equilibrium crystalline, or microcrystalline structure which is produced by the method of this invention exhibits numerous outstanding chemical, electromagnetic, and physical properties as compared with the crystalline metal obtained by the conventional method. Thus, it has a very strong possibility of finding utility in a rich variety of applications involving use of electric and electromagnetic parts, composite materials, and textile materials.

DETAILED DESCRIPTION OF THE INVENTION

Figure 1:
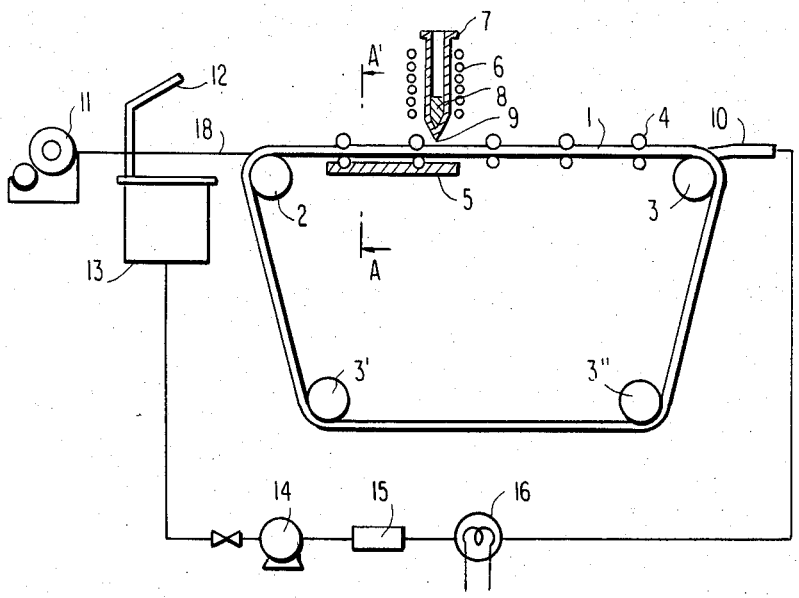
FIGS. 1, 2 and 3 are schematic diagrams of typical devices to be used for working the present invention.

The metals to which the present invention can be effectively applied include pure metals, metals containing minute amounts of impurities, and alloys of all kinds. Among other alloys, particularly desirable alloys for this invention are alloys which acquire excellent properties on being quenched and solidified, such as those alloys which form an amorphous phase and alloys which form non-equilibrium crystalline or microcrystalline particles. Typical examples of the alloys which form an amorphous phase are reported in many pieces of literature such as, for instance, *Science,* No. 8, 1978, pp. 62–72, *Report of Japan Metal Society,* Vol. 15, No. 3, 1976, pp. 151–206, and Metals, Dec. 1, 1971 issue, pp. 73–78 and in many patent publications including Japanese Patent Application (OPI) Nos. 91014/74 (corresponding to U.S. Pat. No. 3,856,513), 101215/75, 135820/74 (corresponding to U.S. Pat. No. 3,845,805), 3312/76, 4017/76, 4018/76, 4019/76, 65012/76, 73920/76, 73923/76, 78705/76, 79613/76, 5620/77, 114421/77, and 99035/79.

Of these alloys, those which excel in ability to form an amorphous phase and enjoy high practicability are Fe-Si-B type, Fe-P-C type, Fe-P-B type, Co-Si-B type, and Ni-Si-B type. Naturally, a great number of kinds of such alloys can be selected from varying metal-metalloid combinations and metal-metal combinations. Better still, alloys possessing outstanding properties which have never been attained by conventional crystalline metals can be combined by making the most of the characteristics of such combinations. In the aforementioned alloy composition, an alloy composed of 3 to 20 atomic% of Si, 5 to 20 atomic% of B and the balance to make up 100 atomic% being comprised substantially of Fe (providing that the total amount of Si and B is 15 to 30 atomic%), an alloy compsed of 7 to 20 atomic% of P, 5 to 20 atomic% of C and the balance to make up 100 atomic% being comprised substantially of Fe (providing that the total amount of P and C is 17 to 35 atomic%), an alloy composed of 20 atomic% or less of P, 15 atomic% or less of B and the balance to make up 100 atomic% being comprised substantially of Fe (providing that the total amount of P and B is 15 to 25 atomic%), an alloy composed of 20 atomic% or less of Si, 5 to 30 atomic% or less of B and the balance to make up 100 atomic% being comprised substantially of Co (providing that the total amount of Si and B is 17 to 35 atomic%), and an alloy composed of 5 to 15 atomic% of Si, 10 to 28 atomic% of B and the balance to make up 100 atomic% being comprised substantially of Ni (providing that the total amount of Si and B is 20 to 35 atomic%). Particularly, $Fe_{75}$-$Si_{10}$-$B_{15}$, $Fe_{78}$-$P_{12}$-$C_{10}$ and $Co_{72.5}$-$Si_{12.5}$-$B_{15}$ are preferred as an alloy having an ability of forming an amorphous phase or a thin wire. Concrete examples of alloys which form a non-equilibrium crystalline phase are Fe-Cr-Al type alloys and Fe-Al-C type alloys reported in Japanese Patent Application (OPI) No. 3651/81, *Iron and Steel,* Vol. 66 (1980), No. 3, pp. 382–389, *Journal of Japan Metal Society,* Vol. 44, No. 3, 1980, pp. 245–254, *Transactions of The Japan Institute of Metals,* Vol. 20, No. 8, August, 1979, pp. 468–471, and *Collection of Outlines of General Lectures at Autumn General Meeting of Japan Metal Society,* (October, 1979), pp. 350–351, and Mn-Al-C type alloys, Fe-Cr-Al type alloys, and Fe-Mn-Al-C type alloys reported in *Collection of Outlines of General Lectures at Autumn General Meeting of Japan Metal Society,* (November, 1981), pp. 423–425.

By the expression "a layer of liquid cooling medium formed on a grooved conveyor belt in motion" as used in the present invention (hereinafter referred to as "layer of liquid cooling medium in motion") is meant a layer of liquid cooling medium which is formed by forming on the surface of a conveyor belt a groove for retaining therein a liquid cooling medium, filling this groove with the liquid cooling medium, and keeping the conveyor belt in motion with the medium held in the groove. The layer of liquid cooling medium in motion is only required to have a thickness of, for example, about at least 1 cm. In view of the industrial application, the preferred upper limit of the thickness is about 4 cm. The length of this layer has to be such as to stabilize the layer of liquid cooling medium in motion and permit efficient quenching and solidification of the flow of molten metal. Particularly, the length is desired to be not less than 5 cm.

To obtain a thin metal wire having more uniform, high quality, addition to the stability of the layer of liquid cooling medium constitutes the most important requirement. Any disturbance suffered to occur in the layer of liquid cooling medium results in production of bent, severed lengths of thin metal wire heavily lacking uniformity of diameter.

Various measures are conceivable for the purpose of stably retaining the layer of liquid cooling medium. One particularly effective measure may comprise causing the grooved conveyor belt to travel in an inwardly curved form and keeping the layer of liquid cooling medium pressed by centrifugal force against the surface of the grooved conveyor belt. Owing to the centrifugal force which is thus exerted upon the layer of liquid cooling medium, the flow of molten metal which is formed when the molten metal is spouted through the spinning nozzle and subsequently quenched and solidified is also caused by the centrifugal force to penetrate amply into the layer of liquid cooling medium and get caught powerfully on the bottom face of the grooved conveyor belt. Consequently, the flow of molten metal is stabilized and the cooling speed is enhanced, making it possible to produce a thin metal wire of very high quality. The stability of the layer of liquid cooling medium in motion and that of the flow of molten metal held within the layer of liquid cooling medium in motion are enhanced in proportion as the centrifugal force exerted on the layer of liquid cooling medium in motion and the centrifugal force exerted on the flow of molten metal spouted out of the spinning nozzle are increased. At the same time, by virtue of the centrifugal force, the flow of molten metal is allowed to pass through the layer of liquid cooling medium in motion and get caught fast on the bottom surface of the grooved conveyor belt. This thin metal wire consequently produced, therefore, enjoys high quality.

To increase the centrifugal force, the radius of curvature of the bent portion of the grooved conveyor belt is desired to be decreased as much as permissible. If the radius of curvature is decreased to excess, however, the service life of the grooved conveyor belt is shortened and the vibration of the belt is intolerably increased. The radius of curvature, therefore, is desired to fall in the range of 10 to 100 cm, preferably 20 to 80 cm. Particularly when a magnetic alloy (an alloy containing iron, cobalt, or nickel, for example) is melted, spouted through the spinning nozzle, and quenched and solidified by being brought into contact with the layer of liquid cooling medium in motion, the centrifugal force may be utilized to keep the layer of liquid cooling medium in motion in a stable condition and, at the same time, suitable magnet means may be disposed on the bottom of the grooved conveyor belt or on the opposite side of the layer of liquid cooling medium in motion relative to the spinning nozzle so as to keep the thin metal wire stably attracted to and immersed in the layer of liquid cooling medium in motion. Consequently, there will be produced a thin magnetic metal wire of high quality.

In producing a uniform thin metal wire continuously, the relation between the speed of the flow of molten metal spouted out of the spinning nozzle ($V_J$) and the speed of the layer of liquid cooling medium in motion ($V_W$), the angle of contact ($\theta$) between the flow of molten metal spouted through the spinning nozzle and the layer of liquid cooling medium in motion, and the distance from the spinning nozzle to the layer of liquid cooling medium naturally constitute themselves important factors. For example, when the speed of the flow of molten metal ($V_J$) is greater than the speed of the layer of liquid cooling medium in motion ($V_W$), thus ($V_J > V_W$), the operation tends to produce a thin metal wire which contains curves and heavily lacks uniformity of diameter. When $V_J < V_W \leqq 1.3V_J$ is satisfied, there is produced a continued, uniform thin metal wire exhibiting little ununiformity of diameter. When $1.3V_J < V_W$ is satisfied, the produced thin metal wire shows little uniformity of diameter but suffers occurrence of breakage. This operation tends to produce short severed lengths of thin metal wire. Particularly to obtain a thin metal wire of high quality having an amorphous or non-equilibrium crystalline structure by increasing the cooling speed, the speed of the layer of liquid cooling medium in motion ($V_W$) is desired to exceed 200 m/min and the angle of contact ($\theta$) between the flow of molten metal and the layer of liquid cooling medium in motion to exceed 30°. Preferably, they are required to exceed 400 m/min and 40°, respectively, and more preferably 400 to 800 m/min and 40° to 90°, respectively.

Conversely, the values of $V_W$ and $\theta$ are desired to be lowered for the purpose of obtaining a uniform thin metal wire without expecting so much of the cooling speed. Owing to the adoption of the method of this invention, a thin metal wire which possesses a desired set of properties and meets a particular purpose can be obtained by freely combining the cooling and solidifying conditions so as to suit the kind of metal used and the quality to be acquired by the metal wire on being cooled and solidified.

Examples of the liquid cooling medium to be advantageously used for the present invention are pure liquids, solutions, and emulsions. The liquid cooling medium to be selected may be such that it will react with the spouted molten metal and form a stable surface layer on the molten metal or it will show no chemical reactivity with the spouted molten metal. Particularly when the flow of molten metal is desired to be converted on being quenched and solidified within the layer of liquid cooling medium into a thin metal wire having a circular cross section, the liquid cooling medium to be selected is desired to be capable of producing a suitable cooling speed and the layer of this liquid cooling medium, while in motion, is desired to be retained stably and prevented from disturbance. Particularly where the cooling speed is required to be amply high, it is desirable to adopt as the liquid cooling medium either water at or below room temperature or an aqueous solution of electrolyte obtained by dissolving a metal salt. The preferred examples of the liquid cooling medium are water at 10° C. or less , 20 wt% aqueous sodium chloride at −15° C., 10 wt% aqueous magnesium chloride solution at −20° C., 20 wt% aqueous magnesium chloride solution at −30° C., and 45 wt% aqueous zinc chloride solution at −50° C.

Generally, the process in which the molten metal is quenched by being brought into contact with the liquid cooling medium is believed to be roughly divided into three steps. The first step covers a duration in which the vapor of the liquid cooling medium forms a film covering the entire surface of the spouted molten metal. The cooling speed in this step is rather slow because the cooling is effected by the radiation through this film of the vapor. In the second step, the film of the vapor is broken and the cooling medium is continuously boiled violently. The heat of the molten metal is predominantly eliminated in the form of heat of vaporization. The cooling speed is highest in this step, therefore. In the third step, the cooling medium ceases to boil and the cooling is effected through conduction and convection. Consequently, the cooling speed is again lowered.

To cool the molten metal quickly, the most effective measures are (A) selecting a liquid cooling medium which shortens the duration of the first step to the fullest extent and enables the molten metal under treatment to reach the second step quickly and (B) utilizing an artificial measure at the earliest possible point to accelerate the motion of the liquid cooling medium or that of the molten metal being cooled, destroy the film of the vapor formed in the first step, and transfer the molten metal to the second step of cooling as soon as possible. The desirability of these measures may be fully evinced by the fact that the cooling speed obtained with violently agitated cold water is at least about four times the cooling speed obtained with cold water at rest. In short, where the cooling speed is desired to be amply high, the liquid cooling medium to be used must fulfill the essential requirement that it should possess a high boiling point and a large latent heat for vaporization, produce only readily diffusible vapor or bubbles, and exhibit high fluidity.

Naturally, low cost, freedom from deterioration, etc., constitute themselves equally important questions. For the purpose of quickly destroying the film of vapor formed during the first step and enabling the cooling of the molten metal to be quickly shifted from the first to the second step so as to increase the cooling speed by artificial measures, it is desirable to adopt a liquid cooling medium which possess a high specific heat, heighten the speed of the layer of liquid cooling medium in motion ($V_W$), heighten the speed of the flow of molten metal ($V_J$) spouted out of the spinning nozzle, increase the angle of contact ($\theta$) between the flow of the spouted molten metal and the layer of liquid cooling medium in motion, and shorten the distance between the spinning nozzle and the layer of liquid cooling medium in motion.

Figure 2:
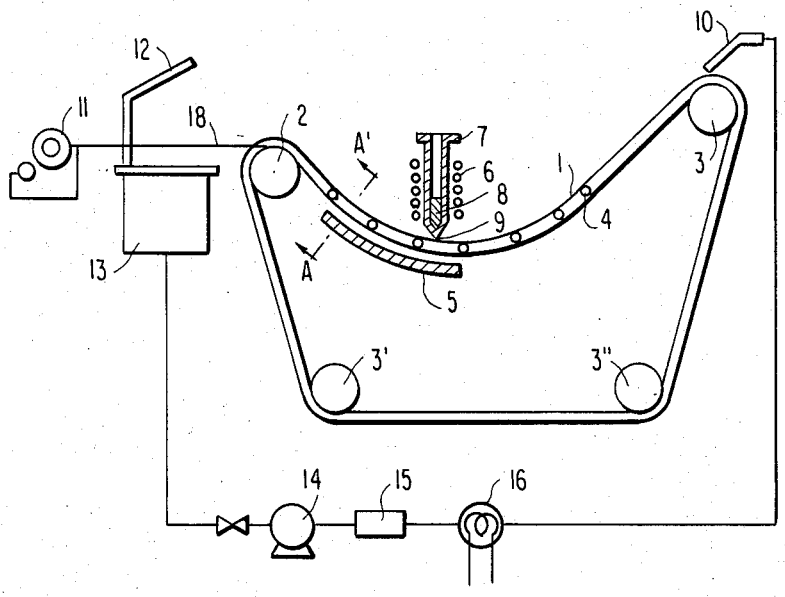
Figure 3:
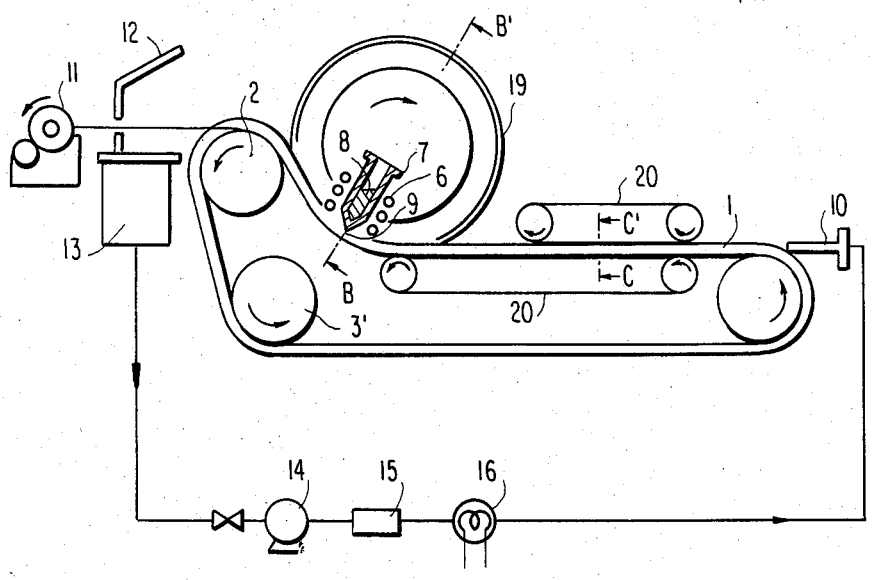
Figure 4:
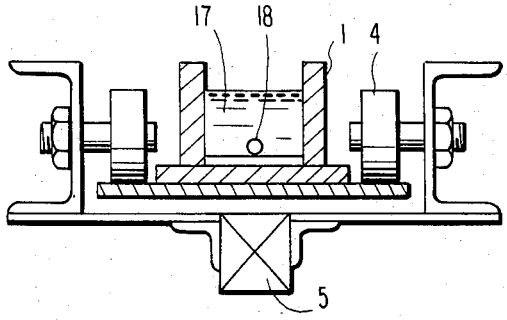
FIG. 4 is a cross section taken along the line A-A' in the diagrams of FIGS. 1 and 2.
Figure 5:
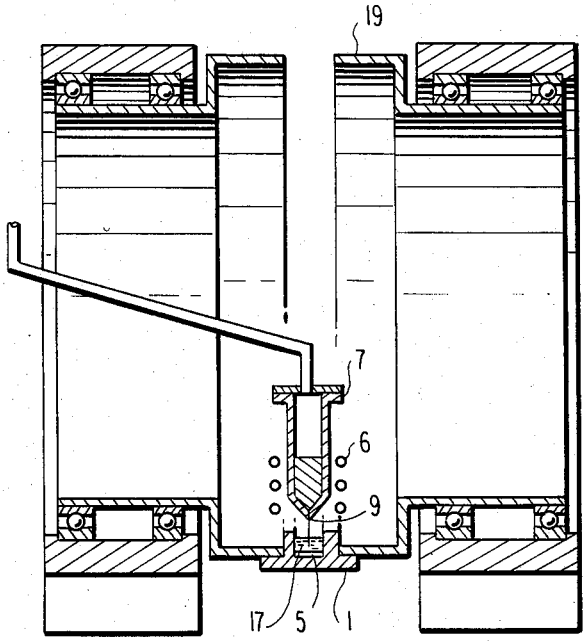
FIGS. 5 and 6 are a cross section taken along the line B-B' and line C-C' in the diagram of FIG. 3.
Figure 6:
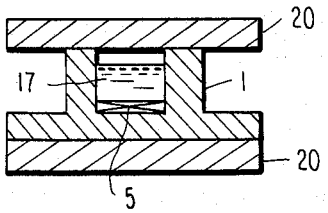

The present invention will now be described in detail below with reference to the accompanying drawings. FIG. 1, FIG. 2 and FIG. 3 represent schematic diagrams illustrating typical devices to be used for embodying the present invention. FIG. 1 illustrates a device wherein a grooved conveyor belt is driven horizontally near a nozzle for spouting molten metal and FIG. 2 and FIG. 3 illustrate a device wherein a grooved conveyor belt is driven in a bent form near and inside a nozzle for spouting molten metal. FIG. 4 represents a cross section taken along the line A—A' in the diagrams of FIG. 1 and FIG. 2. FIG. 5 and FIG. 6 represent a cross section taken along the line B—B' and line C—C' in the diagram of FIG. 3. By 1 is denoted a grooved conveyor belt, which is provided on the surface thereof with two flanges as illustrated in FIG. 4. The grooved conveyor belt 1 permits a layer of liquid cooling medium 17 to be formed in the space intervening between the opposed flanges. Denoted by 2 is a drive pulley for the grooved conveyor belt 1. This drive pulley 2 is interlocked with a drive source whose operating speed can be freely adjusted. By 3, 3' and 3'' are denoted turn pulleys. And by 4 is denoted a guide roller for fixing the path for the travel of the grooved conveyor belt 1. By the mechanism incorporating these components, the grooved conveyor belt 1 is driven along 3→4→2→3'→3''→3. Denoted by 10 is a nozzle for feeding a liquid cooling medium to the groove in the grooved conveyor belt 1.

The grooved conveyor belt may be made of any material insofar as the material is flexible enough for the belt to be driven in a curved path. Examples of desirable material for the grooved conveyor belt are rubber, steel, and plastics. As regards the length of the grooved conveyor belt, the grooved conveyor belt can function satisfactorily when the length thereof is enough to stabilize the layer of liquid cooling medium in motion which has been fed out of the nozzle 10, for example, 1 m or more, preferably 2 m or more. Now as concerns the shape of the cross section of the groove on the conveyor belt, it may be freely selected insofar as the groove in the selected cross section permits the liquid cooling medium in motion to form a layer of a depth of at least 1 cm. The groove satisfactorily fulfills its function when the shape of its cross section is a trapezoid, a rectangle, a semicircle, or a combination thereof, for example.

A liquid baffle 12, a receptacle tank 13 for liquid cooling medium, a transfer pump 14 for liquid cooling medium, a flowmeter 15, a condenser 16, and a thin metal wire winder 11 are disposed as illustrated. Denoted by 6 is a heater for dissolving a metal as the raw material, 7 a melting crucible, 8 molten metal as the raw material, and 18 a flow of thin metal spouted out of a spinning nozzle 9 fastened to the leading end of the melting crucible 7 and quenched and solidified on contact with a layer of liquid cooling medium 17.

By 5 is denoted magnet means (magnet) disposed beneath the grooved conveyor belt 1 in motion. The magnet functions to attract the flow of thin metal 18 downwardly by virtue of magnetism, keep it in contact with the bottom surface of the grooved conveyor belt 1 in motion, take up the flow of thin metal 18 at a fixed speed, stabilize the flow of molten metal spouted out of the spinning nozzle 9 by virtue of the attractive force produced by magnetism, and keep the flow of molten metal immersed intimately in the layer of liquid cooling medium 17 in motion. Owing to the intimate contact thus established, the liquid cooling medium can be expected to effect uniform cooling of the molten metal advantageously. The flow of thin metal 18 tends to float up to the surface of the layer of liquid cooling medium 17 in motion and the expected uniform quenching effect tends to become difficult to obtain particularly when the layer of liquid cooling medium 17 in motion is disturbed and the angle of contact ($\theta$) between the flow of molten metal and the layer of liquid cooling medium 17 in motion is small ($\theta < 20°$), when the speed of the layer of liquid cooling medium 17 in motion ($V_W$) is greater than the speed of the flow of molten metal ($V_J$) spouted out of the cooling nozzle 9, thus $V_W > 1.3V_J$, or when the speed of the layer of liquid cooling medium 17 in motion ($V_W$) is high ($V_W > 600$ m/min) and the flow of molten metal spouted out of the spinning nozzle 9 has a small diameter (namely, when the orifice diameter (Do) of the spinning nozzle is 0.08 mm $\phi$ or less). This difficulty can be overcome by having the magnet means 5 disposed as opposed to the spinning nozzle 9 across the layer of liquid cooling medium 17 as illustrated. A similarly effective measure may be obtained by having a magnet of the shape of a tape or strip directly attached to the bottom of the grooved conveyor belt. When guide rollers 4 or guide drum 19 are set in position as illustrated in FIG. 2 and FIG. 3, the grooved conveyor belt 1 can be caused to travel as bent inwardly at a desired radius of curvature near the point directly below the spinning nozzle 9. Owing to the centrifugal force consequently generated, the layer of liquid cooling medium 17 on the grooved conveyor belt 1 can be more stably retained and, at the same time, the flow of molten metal spouted out of the spinning nozzle 9 can be stably brought into contact with and held immersed in the layer of liquid cooling medium 17 in motion. Thus, the liquid cooling medium can be expected to produce a more desirable cooling speed (exceeding $10^{4°}$ C./sec). In other words, the centrifugal force can be expected to effect stabilization of the layer of liquid cooling medium 17 in motion, stabilization of the flow of molten metal, and improvement in the cooling speed. Thus, the use of the guide rollers meets the purpose of obtaining a thin metal wire having uniform, high quality.

A desired addition to the centrifugal force can be accomplished by decreasing the radius of curvature of the grooved conveyor belt and increasing the travelling speed of the conveyor belt. When the radius of curvature is decreased and the travelling speed of the conveyor belt is increased excessively however, there may ensue problems such as shortened service life of the grooved conveyor belt and intolerable vibrations. Thus, the radius of curvature of the grooved conveyor belt preferably exceeds 20 cm and the travelling speed thereof preferably does not exceed 1,000 m/min.

The conditions under which the device described above is to be operated for the production of a thin metal wire will now be explained in detail below. First, the grooved conveyor belt 1 is driven by the drive pulley 2. The travelling speed ($V_W$) of this grooved conveyor belt 1 is adjusted relative to the speed of the flow of molten metal ($V_J$) which is spouted out of the spinning nozzle 9 fastened to the leading end of the melting crucible 7. It should be freely selected, depending on the shape, performance, and intended use of the thin metal wire to be produced. For example, a warped thin metal wire of highly ununiform diameter is obtained when $V_J \geqq V_W$, a continuous thin metal wire of highly uniform diameter is obtained when $V_J < V_W \leqq 1.3V_J$, and severed lengths of thin metal wire of uniform diameter are obtained when $V_W > 1.3V_J$.

To obtain a thin metal wire of an amorphous structure or non-equilibrium crystalline structure, the cooling speed is preferably increased as much as possible, preferably beyond the level of $10^{4°}$ C./sec. For this purpose, the value of $V_W$ is preferably increased as much as possible, preferably beyond 300 m/min, the angle of contact ($\theta$) between the flow of molten metal and the layer of liquid cooling medium 17 is preferably increased beyond 30°, and the orifice diameter (Do) of the spinning nozzle 9 is preferably decreased below the level of 0.40 mm. At the position of the turn pulley 3 relative to the grooved conveyor belt 1, the nozzle 10 for feeding the liquid cooling medium is disposed in the groove of the grooved conveyor belt 1 so as to supply the liquid cooling medium into the groove on the conveyor belt in motion. The liquid cooling medium, on reaching the groove, begins to flow in a layer 17. This layer of liquid cooling medium 17 in motion is moved forward by the grooved conveyor belt 1. This layer in motion is stabilized as if it were a body of water at rest on the grooved conveyor belt 1.

By freely selecting the relative positions of the guide rollers 4 or varying a diameter of the guide drum 19 as illlustrated in FIG. 2 and FIG. 3, this grooved conveyor belt 1 can be made to travel as bent in a desired radius of curvature. particularly for the purpose of stably retaining the layer of liquid cooling medium 17 in motion on the grooved conveyor belt 1, it is desirable that the grooved conveyor belt 1 is driven as bent inwardly while preventing vertical or horizontal minute vibration of the belt. For the purpose of preventing such vibration of the grooved conveyor belt 1 driven, it is preferred that the grooved conveyor belt 1 is firmly supported in stabilized mode by guide belt 20 at straight positions and guide drum 19 at curvature positions to prevent the belt from its vibration as illustrated in FIG 3, FIG. 5 and FIG. 6. The molten metal is spouted out of the spinning nozzle 9 into the stabilized layer of liquid cooling medium 17 in motion, there to be quenched and solidified. The thin metal wire 18 which has been quenched and solidified is pressed against the bottom surface of the grooved conveyor belt 1 by virtue of the centrifugal force or by magnet means 5. On reaching the position of the drive pulley 2, the liquid cooling medium and the thin metal wire are discharged from the grooved conveyor belt 1 by inertia. The thin metal wire 18 is then wound up on the winder 11. The liquid cooling medium discharged from the grooved conveyor belt is collected by the liquid baffle 12 into the receptacle tank 13 and then forwarded by the transfer pump 14 through the flowmeter 15 and the condenser 16 to the supply nozzle 10.

Generally, since a thin metal wire of high quality having an amorphous or non-equilibrium crystalline structure is obtained more easily by heightening the cooling speed, it is desirable to use as the liquid cooling medium an aqueous electrolyte solution kept below room temperature. Examples of preferred aqueous electrolyte solutions are an aqueous solution containing 25% by weight of soidum chloride, an aqueous solution containing 5 to 15% by weight of caustic soda, an aqueous solution containing 5 to 25% by weight of magnesium chloride or lithium chloride, and an aqueous solution containing 15 to 50% by weight of zinc chloride. The flowmeter 15 serves the purpose of regulating the depth of the layer of liquid cooling medium 17 in motion. The depth of the layer of liquid cooling medium preferably exceeds 1 cm. The distance beween the layer of liquid cooling medium 17 in motion and the spinning nozzle 9 is preferably as small as possible, preferably in the range of 1 to 5 mm. The diameter of the thin metal wire formed is nearly same or smaller to some extend (for example, it is reduced to extent of about 5 to 15%) than the orifice diameter of the spinning nozzle.

The expression "a thin metal wire having a circular cross section" as used in the present invention means that the maximum diameter ($R_{max}$) and the minimum diameter ($R_{min}$) of a given metal wire as measured in one and the same cross section are such that the ratio of $R_{min}/R_{max}$ is no less than 0.6.

The present invention will now be described more specifically below with reference to working examples of the invention.

EXAMPLE 1

A device wherein a grooved conveyor belt was driven horizontally near the point directly below a spinning nozzle as illustrated in FIG. 1 was used. An alloy composed of 75 atom% of Fe, 10 atom% of Si, and 15 atom% of B was melted at 1,300° C. in an atmosphere of argon. Through the spinning nozzle having an orifice diameter (Do) of 0.20 mm, the molten alloy was spouted under an argon pressure of 5.0 kg/cm$^2$ at a contact angle ($\theta$) of 60° into a layer of liquid cooling medium kept at 4° C. to a depth of 2.5 cm on the grooved conveyor belt travelling at a speed of 600 m/min, there to be quenched and solidified. Then, the thin metal wire consequently produced was continuously taken up by the winder 11.

The distance between the spinning nozzle and the layer of liquid cooling medium in motion was kept at 1.5 mm. In this operation, the speed ($V_J$) of the flow of molten metal spouted out of the spinning nozzle was found to be 520 m/min (as determined by measuring the amount of molten metal discharged, $Q_1$ (g/min), per unit time and finding $V_J$ from the equation, $Q_1=\pi(Do/2)^2 \cdot V_J \cdot \rho o$ using the result of the measurement, wherein Do stands for the orifice diameter (cm) of the spinning nozzle and $\rho o$ for the density of the alloy).

The average diameter of the thin metal wire consequently obtained was 0.170 mm and the out-of-roundness thereof (the ratio of $R_{min}/R_{max}$) was 0.95. Thus, the thin metal wire had a circular cross section virtually equalling a true circle. The dispersion of the diameter of this thin metal wire in the direction of length was 4.0%, suggesting that the continuous thin metal wire had high quality. It was found to possess 355 kg/mm$^2$ of tensile strength at breakage and 3.5% of elongation at breakage, suggesting that this wire enjoyed high strength and high toughness.

When this thin metal wire was drawn with a diamond die to a diameter of 0.140 mm $\phi$, there was consequently obtained a thin metal wire of highly uniform appearance, with the tensile strength at breakage imporved to 390 kg/mm$^2$ and the elongation at breakage to 5.0%, respectively. When thin metal wire was tested by the X-ray diffraction using as $FeK_\alpha$ irradiation for crystallinity, there was observed only a broad diffraction peak characteristic of an amorphous texture.

The dispersion of diameter in the direction of length was determined by measuring diameters at a total of ten points selected randomly on a 10-meter sample wire, dividing the difference between the maximum and minimum diameters found in the measurement by the average diameter, and multiplying the difference by 100.

EXAMPLE 2

A device wherein a grooved conveyor belt was driven as bent with a radius of curvature of 75 cm near the point directly below a spinning nozzle as illustrated in FIG. 2 was used. An alloy composed of 45 atom% of Fe, 38 atom% of Mn, 10 atom% of Al and 7 atom% of C and having an ability to form a non-equilibrium crystalline structure was melted at 1,400° C. in an atmosphere of argon. Through the spinning nozzle having an orifice diameter of 0.15 mm $\phi$, the molten metal was spouted under an argon pressure of 4.5 kg/cm$^2$ at a contact angle ($\theta$) of 80° into a layer of liquid cooling medium (aqueous solution containing 10% by weight of magnesium chloride) kept at −20° C. to a depth of 3.0 cm and formed in the groove of the grooved conveyor belt travelling at a speed of 500 m/min, there to be quenched and solidified. The thin metal wire consequently obtained was continuously taken up by the winder.

During this operation, the distance between the spinning nozzle and the layer of liquid cooling medium was kept at 2.0 mm. The speed ($V_J$) of the flow of molten metal spouted out of the spinning nozzle was found to be 425 m/min.

The thin metal wire thus-produced had an average diameter of 0.130 mm $\phi$ and showed 95 kg/mm$^2$ of tensile strength at breakage, 35% of elongation, 0.90 of out-of-roundness, and 5.0% of dispersion of diameter. It was a highly tenacious thin metal wire.

When this thin metal wire was cold drawn with a diamond die to a diameter of 0.050 mm $\phi$, there was consequently obtained an extremely thin metal wire exhibiting 260 kg/mm$^2$ of tensile strength at breakage and 1.3% of elongation, suggesting that this wire had very high strength.

When this thin metal wire was tested for crystalline texture by the X-ray diffraction using an $FeK_\alpha$ irradiation and measured for crystal diameter under an electron microscope, it was found to possess a tenacious non-equilibrium chemical phase of Ni3Al type, made up of microcrystalline particles not more than about 1.5 $\mu$m in diameter.

EXAMPLE 3

The same device as adopted in Example 1 was used. An alloy composed of 80 atom% of Al and 20 atom% of Cu was melted at 650° C. in an atmosphere of argon. Through the spinning nozzle having an orifice diameter of 0.30 mm $\phi$, the molten metal was spouted under an argon pressure of 1.0 kg/cm$^2$ at a varying contact angle ($\theta$) into a layer of liquid cooling medium kept at 10° C. to a depth of 1.5 cm and formed on the grooved conveyor belt travelling at a varying speed ($V_W$), there to be quenched and solidified. The thin metal wires thus-produced were tested for dispersion of diameter, out-of-roundness, and continuity. The results were as shown in Table 1.

During this operation, the speed ($V_J$) of the flow of molten metal spouted out of the spinning nozzle was 200 m/min.

TABLE 1

| No. | $\theta$ (°) | $V_W$ (m/min) | Dispersion of Diameter (%) | Out-of-Roundness | Continuity | Shape |
|---|---|---|---|---|---|---|
| 1 | 20 | 150 | 75 | 0.80 | Continued | Warped |
| 2 | 20 | 210 | 5.0 | 0.92 | Continued | Straight |
| 3 | 20 | 300 | — | 0.95 | Not continued | " |
| 4 | 10 | 210 | 3.0 | 0.96 | Continued | " |
| 5 | 40 | 210 | 7.5 | 0.80 | " | " |
| 6 | 60 | 210 | 10.0 | 0.65 | " | " |

Since the alloy had a low melting point, the dispersion of diameter tended to increase and the out-of-roundness to decrease when the angle of contact ($\theta$) was increased as in Test Run Nos. 5 and 6. In Test Run No. 1 wherein the speed ($V_W$) of the layer of liquid cooling medium was smaller than the speed ($V_J$) of the flow of molten metal, there was produced a warped thin metal wire which showed a heavy dispersion of diameter. In Test Run No. 3 wherein the relation between the two speeds was reversed as $V_W > 1.3V_J$, no continuous thin metal wire was obtained and short severed lengths of thin metal wire were obtained instead. In Test Run No. 2, there was produced a unifrom, continuous thin metal wire of microcrystalline structure which showed 55 kg/mm$^2$ of tensile strength and 3.0% of elongation.

As shown in Table 1, thin metal wires possessed of varying properties and shapes could be obtained by selecting the conditions of cooling and solidification, depending on the purpose of use.

EXAMPLE 4

A device wherein a grooved conveyor belt was driven as bent with a radius of curvature of 30 cm near the point directly below a spinning nozzle and a ribbon of magnet was attached directly to the inside bottom of the grooved conveyor belt as illustrated in FIG. 3 was used. An alloy composed of 72.5 atom% of Co, 12.5 atom% of Si, and 15 atom% of B was melted at 1,300° C. in an atmosphere of argon. Through the spinning nozzle having an orifice diameter (Do) of 0.13 mm $\phi$, the molten metal was spouted under an argon pressure of 4.5 kg/mm$^2$ at a contact angle of 75° into a layer of liquid cooling medium kept at 4° C. to a depth of 2.5 cm and formed on the grooved conveyor belt travelling at a speed of 500 m/min, there to be quenched and solidified. The thin wire metal thus-obtained was continuously taken up by the winder 11. During this operation, the distance between the spinning nozzle and the layer of liquid cooling medium was kept at 1.0 mm. In this case, the speed ($V_J$) of the flow of molten metal spouted out of the spinning nozzle was found to be 475 m/min.

The thin metal wire thus-produced had an average diameter of 0.125 mm $\phi$ and showed 0.98 of out-of-roundness and 1.5% of dispersion of diameter in the direction of length. This was a uniform, continuous thin metal wire of very high quality having an amorphous structure.

While the invention has been described in detail and with reference to specific embodiments thereof, it will be apparent to one skilled in the art that various changes and modifications can be made therein without departing from the spirit and scope thereof.

What is claimed is:

1. A method for the manufacture of a thin metal wire having a circular cross section, comprising the steps of spouting molten metal through a spinning nozzle and bringing the resultant flow of molten metal into contact with a layer of liquid cooling medium forming a liquid coolant run within an exterior groove on an upper surface portion of a moving endless conveyor belt thereby quenching and solidifying said flow of molten metal.

2. A method for the manufacture of a thin metal wire as claimed in claim 1, wherein said layer of liquid cooling medium formed on said grooved conveyor belt is a running body of liquid cooling medium kept pressed against said conveyor belt by virtue of centrifugal force generated by said grooved conveyor belt being driven as bent; and wherein said grooved conveyor belt is bent sufficiently to generate an operative level of centrifugal force.

3. A method for the manufacture of a thin metal wire as claimed in claim 1, wherein said layer of liquid cooling medium formed on said grooved conveyor belt is a body of liquid cooling medium driven between said spinning nozzle and a magnet means.

4. A method for the manufacture of a thin metal wire as claimed in claim 1, wherein a magnet means is provided on the bottom of said grooved conveyor belt.

5. A method for the manufacture of a thin metal wire as claimed in claim 1, wherein the molten metal is a metal alloy capable of forming an amorphous phase.

6. A method for the manufacture of a thin metal wire as claimed in claim 5, wherein the metal alloy is an alloy of the type selected from the group consisting of Fe-Si-B type, Fe-P-C type, Fe-P-B type, Co-Si-B type, and Ni-Si-B type.

7. A method for the manufacture of a thin metal wire as claimed in claim 1, wherein the layer of liquid cooling medium has a thickness of 1 cm or more.

8. A method for the manufacture of a thin metal wire as claimed in claim 7, wherein the layer of liquid cooling medium has a length of 5 cm or more.

9. A method for the manufacture of a thin metal wire as claimed in claim 2, wherein the bent portion of the conveyor belt has a curvature having a radius within the range of 10 to 100 cm.

10. A method for the manufacture of a thin metal wire as claimed in claim 9, wherein said curvature has a radius within the range of 20 to 80 cm.

11. A method for the manufacture of a thin metal wire as claimed in claim 1, wherein the speed of the flow of molten metal is slower than the speed of the liquid cooling medium moved on the conveyor belt.

12. A method for the manufacture of a thin metal wire as claimed in claim 11, wherein the speed of the liquid cooling medium moved on the conveyor belt is 1.3 times or more greater than the speed of the flow of molten metal.

13. A method for the manufacture of a thin metal wire as claimed in claim 1, wherein the flow of metal contacts the liquid cooling medium at an angle of 30° or more.

14. A method for the manufacture of a thin metal wire as claimed in claim 13, wherein the angle of contact between the flow of molten metal and the liquid cooling medium is 40° or more.

15. A method for the manufacture of a thin metal wire as claimed in claim 14, wherein the liquid cooling medium is moved at a speed of 400 m/min or more.

16. A method for the manufacture of a thin metal wire as claimed in claim 1, wherein the liquid cooling medium is an aqueous electrolyte solution.

17. A method for the manufacture of a thin metal wire as claimed in claim 1, wherein the liquid cooling medium is an aqueous solution containing 5 to 15% by weight of caustic soda.

18. A method for the manufacture of a thin metal wire as claimed in claim 1, wherein the liquid cooling medium is an aqueous solution containing 5 to 25% by weight of magnesium chloride or lithium chloride.

19. A method for the manufacture of a thin metal wire as claimed in claim 1, wherein the liquid cooling medium is comprised of an aqueous solution containing about 15 to 50% by weight of zinc chloride.

20. A method for the manufacture of a thin metal wire as claimed in claim 1, wherein the distance between the cooling medium and the spinning nozzle is within the range of 1 to 5 mm.

* * * * *